US006484844B2

(12) United States Patent
Sugiyama et al.

(10) Patent No.: US 6,484,844 B2
(45) Date of Patent: Nov. 26, 2002

(54) SPEAKER

(75) Inventors: Shigeru Sugiyama, Sizuoka (JP); Hajime Kitamura, Sizuoka (JP); Naohiro Fujinami, Shizuoka (JP); Masami Kushida, Shizuoka (JP); Hisashi Kubota, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 33 days.

(21) Appl. No.: 09/791,864

(22) Filed: Feb. 26, 2001

(65) Prior Publication Data

US 2001/0017231 A1 Aug. 30, 2001

(30) Foreign Application Priority Data

Feb. 25, 2000 (JP) ..... 2000-050197

(51) Int. Cl.[7] ..... H04R 9/06; H04R 7/00
(52) U.S. Cl. ..... 181/161; 381/409
(58) Field of Search ..... 181/157, 161, 181/171; 381/410, 433, 409, 396, 398, 400, 401, 405, 397

(56) References Cited

U.S. PATENT DOCUMENTS 3,906,171 A * 9/1975 Braceley ..... 381/397
4,531,025 A * 7/1985 Danley et al. ..... 381/404
6,088,466 A * 7/2000 Proni ..... 381/398

* cited by examiner

*Primary Examiner*—Khanh Dang
(74) *Attorney, Agent, or Firm*—Sughrue Mion, PLLC

(57) ABSTRACT

By forming a flange portion (16*a*1) protruding inward in the radial direction at an upper end portion (16*a*) of a voice coil (16), a coiling sectional shape of the voice coil (16) is set to a L-shape. And, the upper end portion (16*a*) of this voice coil (16), is bonded and fixed to a central flat portion (12*b*) of a diaphragm (12). Hereby, by only increasing slightly the weight of the usual voice coil having an I-shaped coiling section, the large bonding area can be obtained between the voice coil (16) and the diaphragm (12), so that separation of the voice coil (16) can be prevented. Further, since other portions of the voice coil (16) than the upper end portion (16*a*) thereof have the usual coil thickness, it is not necessary to expand the width of a cylindrical magnetic gap G in a magnetic circuit unit (18), whereby it is prevented that electroacoustic conversion efficiency of a speaker (10) lowers.

9 Claims, 5 Drawing Sheets

PRIOR ART

SPEAKER

BACKGROUND OF THE INVENTION

1. Field of the Invention

The present invention relates to a dynamic speaker, and particularly to a structure for fixing a voice coil to a diaphragm in the dynamic speaker.

2. Description of the Related Art

As one type of a speaker, a dynamic speaker has been known heretofore. The dynamic speaker, as disclosed in, for example, JP-A-6-178390, comprises generally a diaphragm, a voice coil of which one end portion is fixed to the diaphragm, and a magnetic circuit unit defining a cylindrical magnetic gap for placing the other end portion of the voice coil therein.

As the fixing structure of the voice coil to the diaphragm, the following structure is known, as disclosed in the JP publication. One end portion 2*a* of a voice coil 2 having an I-shaped coiling section as shown in FIG. 5A is bonded and fixed to a diaphragm 4.

However, in the speaker having such a fixing structure, since the large bonding area cannot be obtained, the fixing strength is insufficient. Accordingly, there is fear that the voice coil 2 peels off and separates from the diaphragm 4 during being used. Particularly, in case that the speaker is mounted on an automobile or the like, since it is used under environment where considerable vibration and shock load are applied, the voice coil 2 is easier to separate from the diaphragm.

On the other hand, as shown in FIG. 5B, in case that the coiling thickness of the voice coil 2 is set large, the relatively large bonding area between its one end portion 2*a* and the diaphragm 4 can be obtained, whereby the sufficient fixing strength can be obtained.

However, in this case, since a width of a cylindrical magnetic gap G of a magnetic circuit unit 6 becomes large, there is a problem that electroacoustic conversion efficiency of the speaker degrades. Further, the larger the coiling thickness of the voice coil 2 is, the larger the weight of the voice coil 2 becomes, whereby the large load acts on the bonding surface. Therefore, there is also a problem that separation preventing effect cannot be obtained as expected.

SUMMARY OF THE INVENTION

The invention has been made in consideration of these circumstances, and an object of the invention is to provide a speaker in which separation of a voice coil can be prevented without worsening acoustic characteristic of a dynamic speaker.

In order to achieve the object, a coiling sectional shape of the voice coil has been improved by the invention.

Namely, there is provided a speaker comprising:

a diaphragm;

a magnetic circuit unit defining a cylindrical magnetic gap; and a voice coil having a first portion bonded to the diaphragm, and a second portion placed in the cylindrical magnetic gap;

wherein a thickness of the first portion of the voice coil is set larger than that of the second portion of the voice coil.

The "diaphragm" and "magnetic circuit unit" are not particularly limited in their concrete constitution such as their material, shapes, and the like as long as they can be used as a component of the dynamic speaker.

Further, the "voice coil" is not particularly limited in its concrete coiling sectional shape as long as its coiling thickness at the first portion is set larger than that at other portions.

As indicated in the constitution, in the speaker according to the invention, the first portion of the voice coil is bonded and fixed to the diaphragm. Since the coiling thickness of the voice coil at the first portion is set larger than that at the other portions, the large bonding area between the first portion thereof and the diaphragm can be obtained without considerably increasing the weight of the voice coil. Therefore, it is possible to prevent the large load onto the bonding surface caused by the increase of the weight of the voice coil unlike the case where the coiling thickness of the voice coil is made large in whole, and the sufficient fixing strength of the voice coil in relation to the diaphragm can be obtained.

Further, since the coiling thickness of the voice coil at the other portions is set relatively small, it is not necessary to expand the width of the cylindrical magnetic gap in the magnetic circuit unit, and the large bonding area can be obtained between the first portion thereof and the diaphragm. Therefore, without lowering electroacoustic conversion efficiency of the speaker, the effects can be obtained.

As described above, according to the invention, the separation of the voice coil can be prevented without worsening properties of the speaker in the dynamic speaker.

In the constitution, as described above, the coiling sectional shape of the voce coil is not limited particularly. In case that the coiling section is substantially L-shaped by forming a flange that protrudes inward in the radial direction at the first portion, the large bonding area can obtained in a state where the increase of the weight of the voice coil is kept to a minimum. Further, without considerably complicating the coiling operation of the voice coil, the coiling thickness of the voice coil at the first portion thereof can be set larger than that at other portions.

BRIEF DESCRIPTION OF THE INVENTION

DETAILED DESCRIPTION OF THE PRESENT INVENTION

An embodiment of the invention will be described below with reference to the accompanying drawings.

Figure 1:
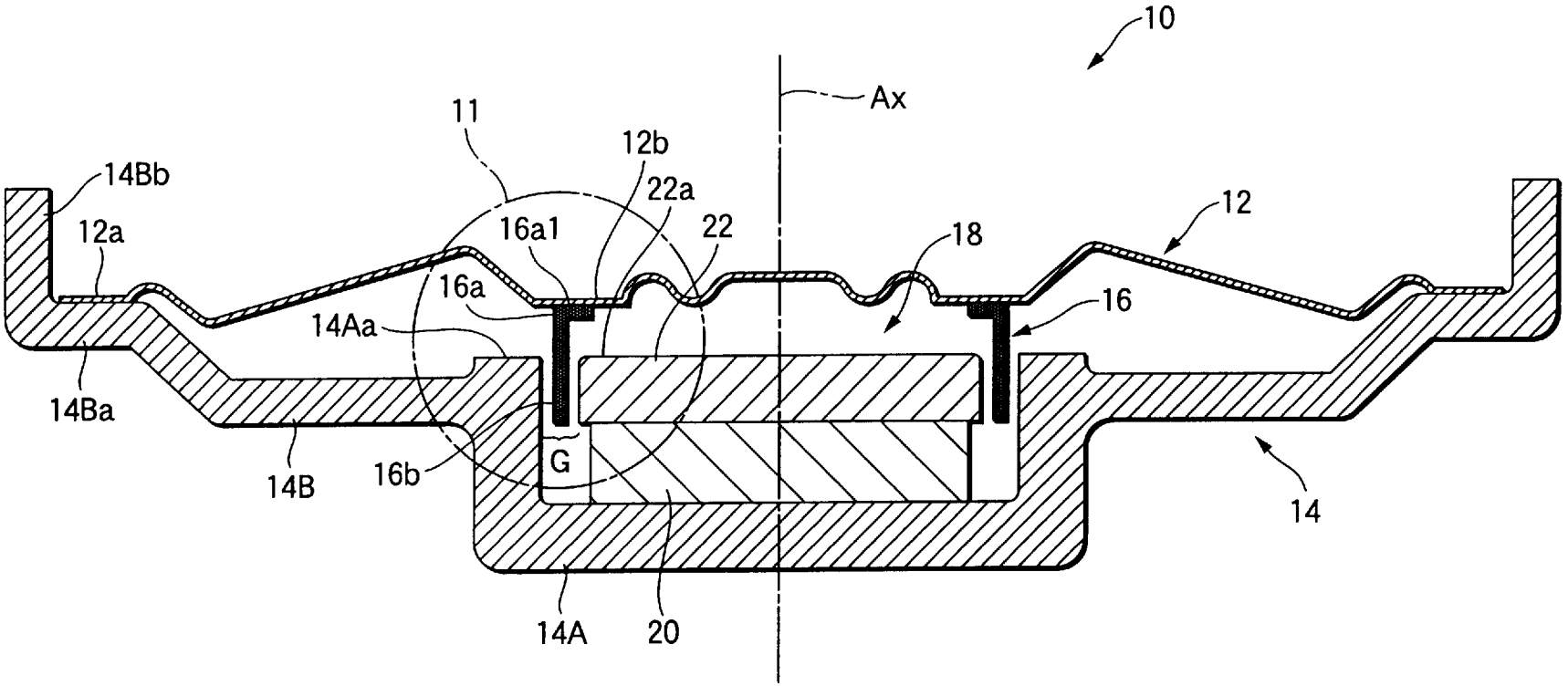
FIG. 1 is a side sectional view of a speaker according to an embodiment for carrying out the invention, in which the speaker faces upward.
Figure 2:
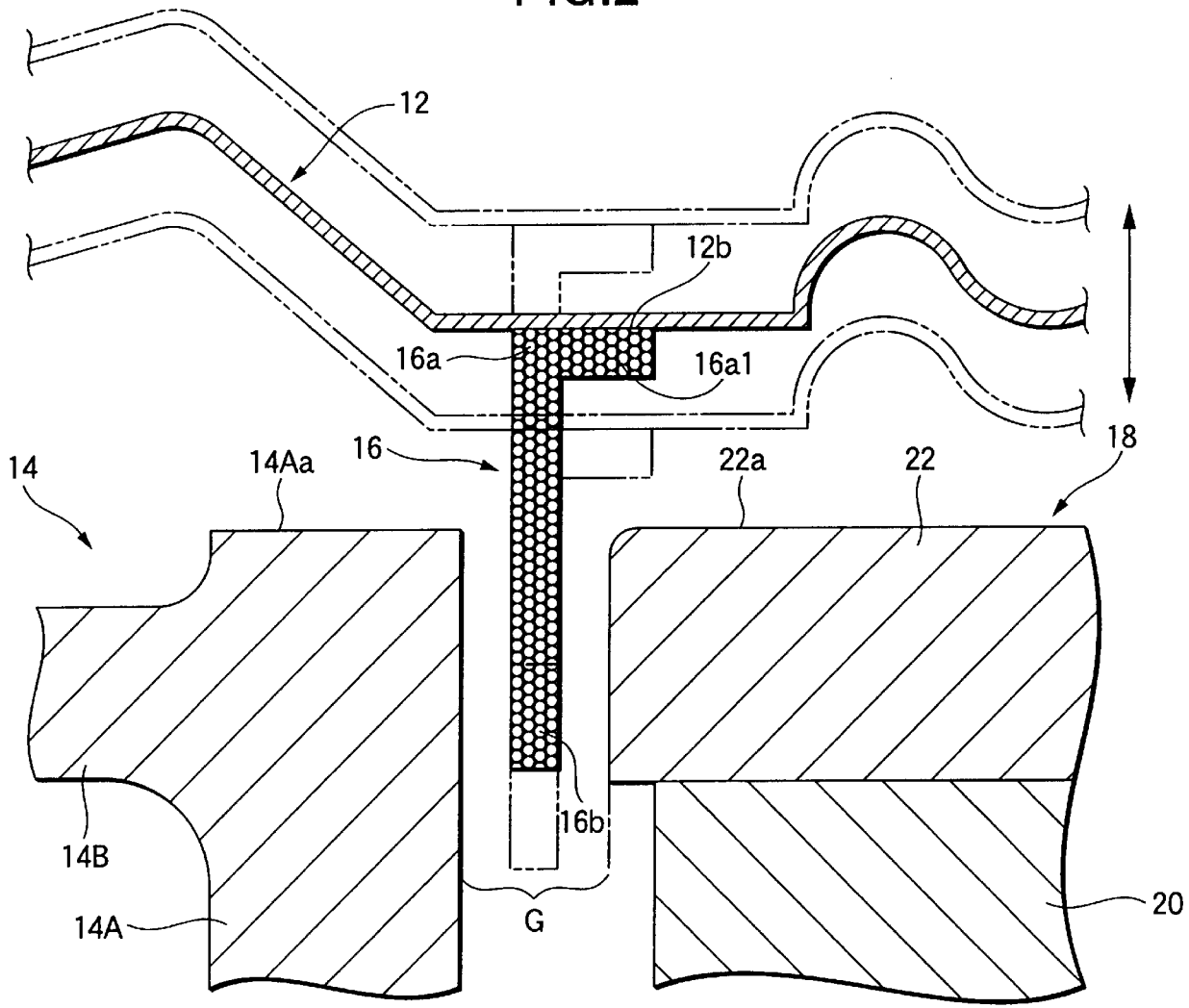
FIG. 2 is a detailed diagram of a II portion in FIG. 1.
Figure 3:
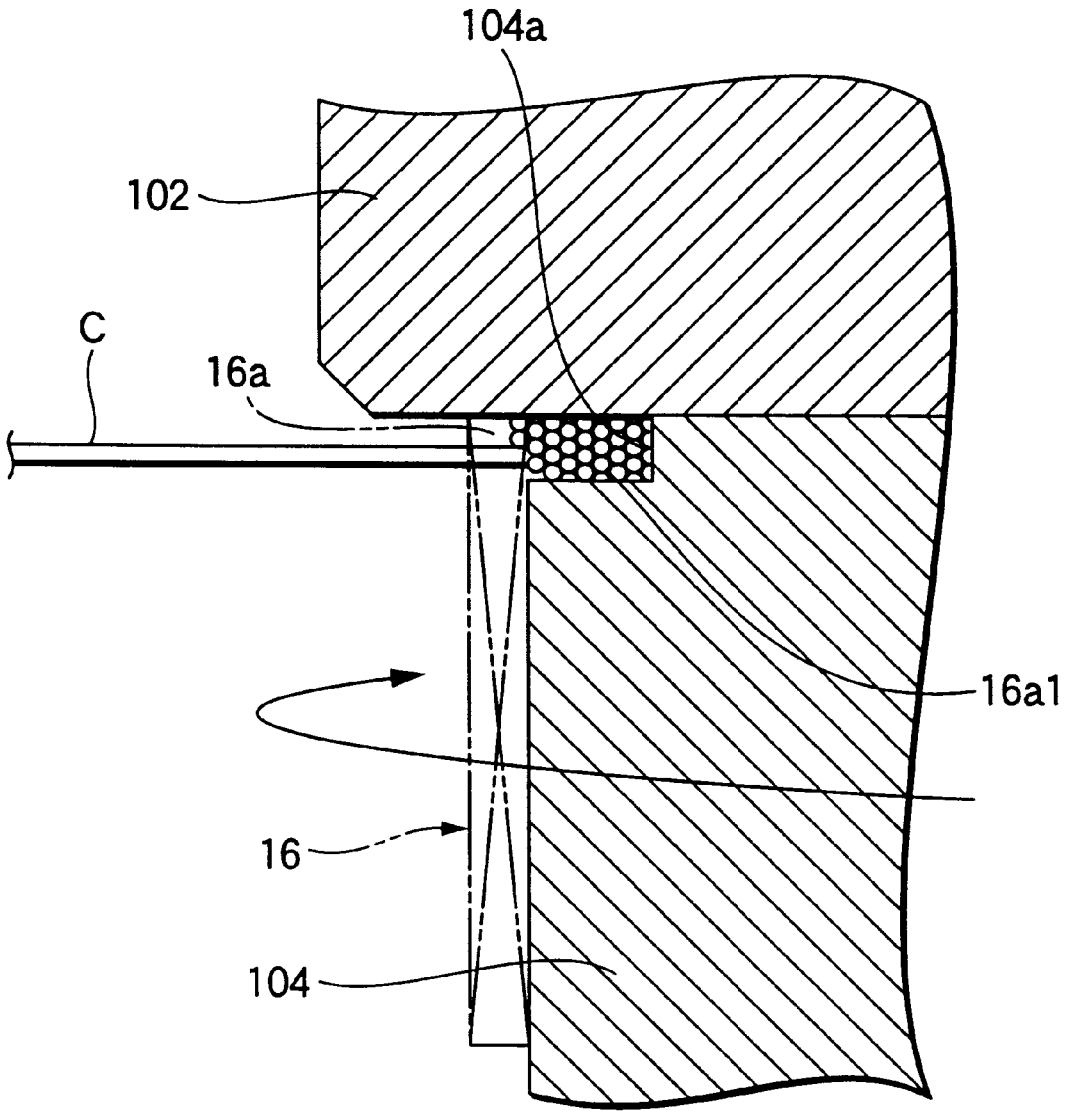
FIG. 3 is a main portion side sectional view showing a process for molding a voice coil in the embodiment.

FIG. 1 is a side sectional view of a speaker 10 according to the embodiment of the invention, in which the speaker faces upward, and FIG. 2 is a detailed diagram of a II portion in FIG. 1.

As shown in FIG. 1, the speaker 10 according to the embodiment is a dynamic speaker comprising a diaphragm 12, a frame 14, a voice coil 16 and a magnetic circuit unit 18. This speaker 10 is a small-sized speaker having an outer diameter of about 30 mm, and used as, for example, a generator of alarm or the like, which is mounted on a base plate in a state where it has been stored in a case (not shown) and loaded on an automobile or the like.

The diaphragm 12 is a member having a plurality of unevenness formed concentrically, and the diaphragm 12 is formed by applying heat press molding to a synthetic resin film. A peripheral edge flat portion 12*a* of the diaphragm 12 and a central flat portion 12*b* are located on the same horizontal annular plane.

The frame 14 is a steel member, and comprises a bottomed cylinder portion 14A located in the center and an annular mounting portion 14B that extends outward in the diameter direction from the vicinity of the upper end portion on the outer surface of this bottomed cylinder portion 14A. In the mounting portion 14B, a plurality of through-holes (not shown) is formed at a predetermined interval in the circumferential direction. And, at the peripheral edge portion of the mounting portion 14B, there are formed an annular flat portion 14B*a* located above an upper end surface 14A*a* of the bottomed cylinder portion 14A and a flange portion 14B*b* extending upward from this annular flat portion 14B*a*.

The diaphragm 12, at its peripheral edge flat portion 12*a*, is bonded and fixed to the annular flat portion 14B*a* of the mounting portion 14B of the frame 14. The bond-fixing is performed in a state where the diaphragm 12 and the frame 14 are arranged so as to be concentric with each other in relation to a central axis Ax of the speaker 10.

The voice coil 16 is arranged so as to be concentric with the diaphragm 12, and an upper end portion 16*a* (one end portion) of the voice coil 16 is bonded and fixed to the central flat portion 12*b* of the diaphragm 12. The fixing structure will be described later.

The magnetic circuit unit 18 includes the bottomed cylinder portion 14A of the frame 14, a magnet 20 and a steel yoke 22. Both of the magnet 20 and yoke 22 are formed in the shape of a disk, placed on a bottom surface of the bottomed cylinder portion 14*a* in this order so as to be concentric with each other, and bonded and fixed to the frame 14. The magnetic circuit unit 18 is set so that an upper end surface 22*a* of the yoke 22 has substantially the same height as the upper end surface 14A*a* of the bottomed cylinder portion 14A, and a cylindrical magnetic gap G is formed, between the outer surface of the yoke 22 and the inner surface of the bottomed cylinder portion 14*a*, with the same width in the entire surrounding. And, in the cylindrical magnetic gap G, a lower portion 16*b* (other end portion) of the voice coil 16 is placed.

As shown in FIG. 2, a coiling sectional shape of the voice coil 16 is set to a shape of L in which a flange portion 16*a*1 that protrudes inward in the radial direction is formed at an upper end portion 16*a*. Hereby, the bonding area between the upper end portion 16*a* of the voice coil 16 and the central flat portion 12*b* of the diaphragm 12 is sufficiently obtained.

The diaphragm 12 and voice coil 16 move up and down, when the speaker is driven, in a range shown by a two-dots chain line in FIG. 2. The height of the flange portion 16*a*1 is set so that clearance is provided in some degree between the flange portion 16*a*1 and the upper end surface 22*a* of the yoke 22 even when the vibration occurs with the maximum amplitude.

The voice coil 16 is formed using a coiling press jig 102 and a coiling receiver jig 104.

The coiling press jig 102 is formed in the shape of a column having the larger diameter than the diameter of the voice coil 16. On the other hand, the outer diameter of the coiling receiver jig 104 is set to the same value as the inner diameter of the voice coil 16, and an upper end portion of the jig 104 is formed as a small-diameter recess portion 104*a* having the same shape as the inner surface and the lower end surface of the flange portion 16*a*1. And, in a state where the lower end surface of the coiling press jig 102 and the upper end surface of the coiling receiver jig 104 are brought into contact with each other, a leading end portion of a coil wire C is hung on the small-diameter recess portion 102*a* of the coiling receiver jig 104. Thereafter, the both jigs 102 and 104 are rotated around the central axis Ax (refer to FIG. 1) and the coil wire C is moved up and down in the predetermined range, whereby the coil wire C is on the outer surface of the coiling receiver jig 104 thereby to form the voice coil 16 having the coiling section of the L-shape in which the flange portion 16*a*1 is formed at the upper end portion 16*a*.

As the coil wire C, a wire coated with fusion-bonding synthetic resin is used. And, immediately before the coiling, hot wind is blown against the wire C in order to melt the coating, whereby the wound wire C is fusion-bonded mutually to form the voice coil 16. Further, the coiling number of the coil wire C is set to an even number (for example, the coiling number at the upper end portion 16*a* is twelve and the coiling number at other portions is four), so that both leading end trailing ends of the wire are drawn out from the upper end portion 16*a* of the voice coil 16.

As described above, in the speaker 10 according to the embodiment, the upper end portion 16*c* of the voice coil 16 is bonded and fixed to the central flat portion 12*b* of the diaphragm 12. Since the voice coil 16 has the coiling section of the L-shape in which the flange portion 16*a*1 is formed at the upper end portion 16*a*, by only increasing slightly the weight of the usual voice coil having the I-shaped coiling section, the large bonding area can obtained between the upper end portion 16*a* and the diaphragm 12.

Therefore, unlike the case where the coiling thickness of the voice coil having the I-shaped coiling section is only made large in whole, it is possible to prevent the large load caused by the increase of the weight of the voice coil from acting onto the bonding surface, and the sufficient fixing strength of the voice coil 16 in relation to the diaphragm 12 can be obtained.

Further, since other portions of the voice coil 16 than the upper end portion 16*a* thereof have the usual coiling thickness, it is not necessary to expand the width of the cylindrical magnetic gap G in the magnetic circuit unit 18, whereby without lowering electroacoustic conversion efficiency of the speaker 10, the effects can be obtained.

Therefore, according to the invention, the separation of the voice coil 16 can be prevented without worsening the properties of the speaker.

Accordingly, even in case that the speaker 10 according to the embodiment is used under environment where large vibration and shock load act, for example, even in case that the speaker 10 is used as a speaker mounted on an automobile, it can be sufficiently fit for use.

Particularly in the emdodiment, since the flange portion 16*a*1 is formed at the upper end portion 16*a* of the voice coil 16 so as to protrude inward in the radial direction, when the coiling operation of the voice coil is performed, the predetermined small-diameter recess portion 104*a* is previously formed at the upper end portion of the coiling receiver jig 104, whereby the voice coil 16 having the L-shaped coiling sectional shape can be readily formed.

In the embodiment, the sectional shape of the flange portion 16*a*1 is set to a rectangular shape. However, the flange portion may have other sectional shapes than this shape, needles to say.

Figure 4B:
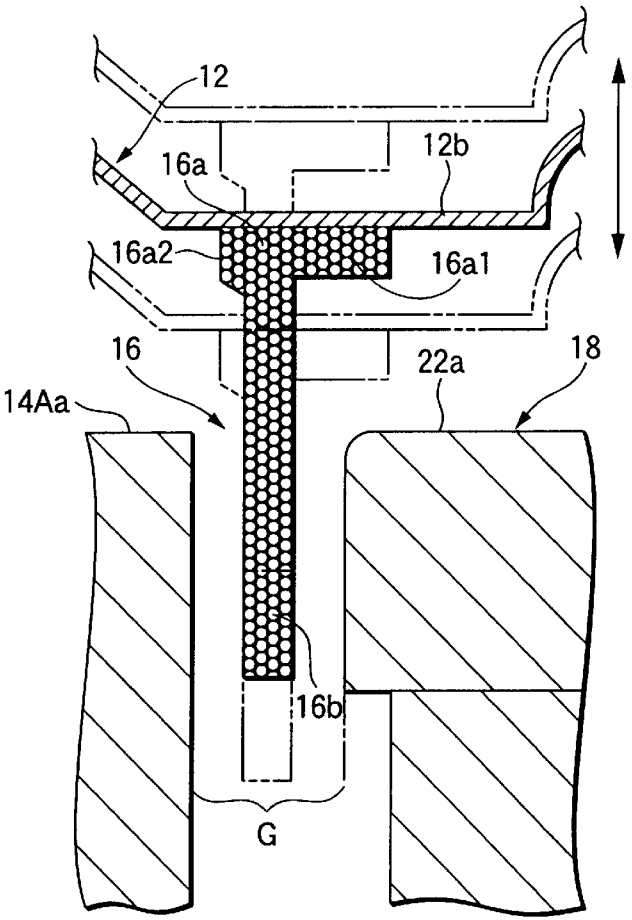
FIGS. 4A and 4B are diagrams similar to FIG. 2, showing modification of the embodiment.
Figure 4A:
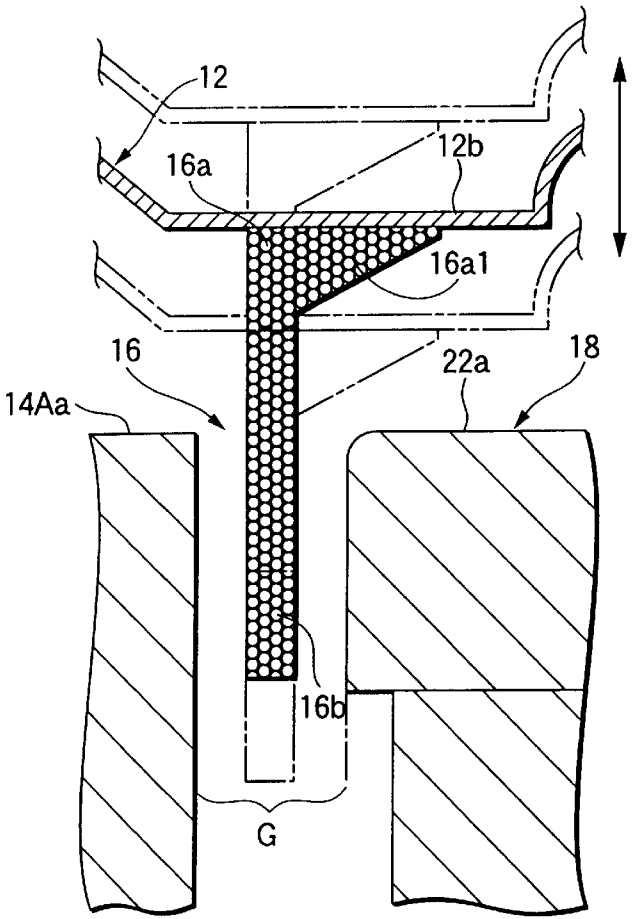
Figure 5B:
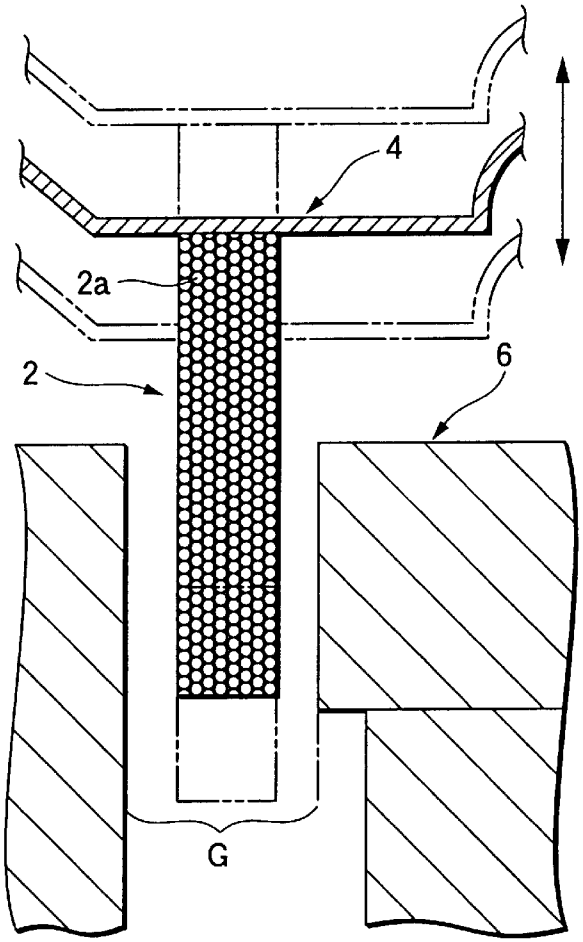
PRIOR ART FIG.5B
FIGS. 5A and 5B are diagrams similar to FIG. 2, showing a conventional example.
Figure 5A:
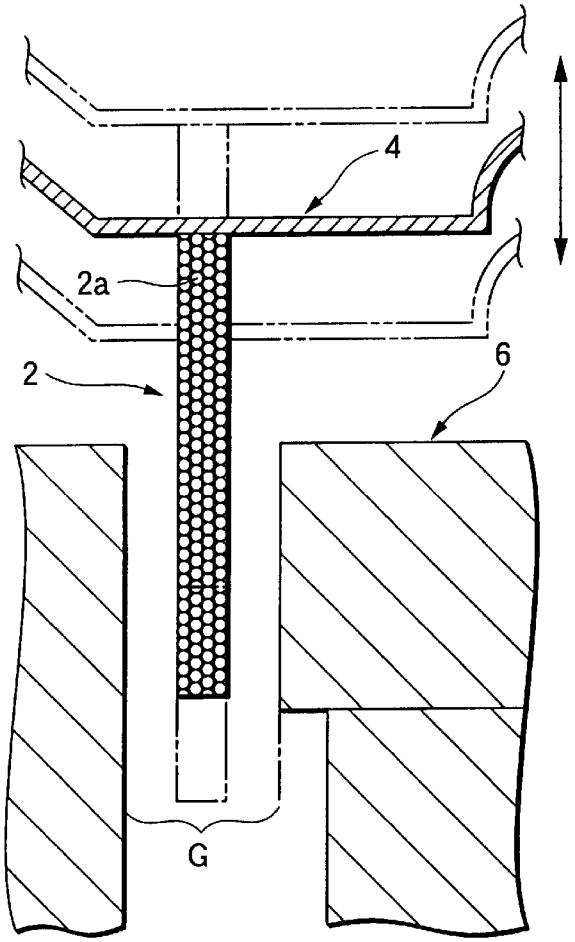

For example, as shown in FIG. 4A, a flange portion 16*a*1 can be adopted, which has a wedge-shaped section in which the vertical width becomes gradually narrower inward in the radial direction. By adopting this sectional shape, the increase of the weight of the voice coil 16 is kept to a minimum. Further, the large bonding area can be obtained between its upper end portion 16*a* and the diaphragm 12 and rigidity of the voice coil 16 itself can be heightened.

Further, as shown in FIG. 4B, not only the flange portion 16*a*1 protruding inward in the radial direction but also a flange portion 16*a*2 protruding outward in the radial direction may be formed at the upper end portion 16*a* of the voice coil 16, whereby the large bonding area can be obtained between its upper end portion 16*a* and the diaphragm 12.

In the embodiment, the case where the speaker 10 is a small-sized speaker is described. However, even in case that it is a larger speaker, by adopting the similar constitution to that in the embodiment, the similar effects to those in the embodiment can be obtained.

What is claimed is:

1. A speaker comprising:

a diaphragm;

a magnetic circuit unit defining a cylindrical magnetic gap; and a voice coil having a first portion bonded to the diaphragm, and a second portion placed in the cylindrical magnetic gap;

wherein a thickness of the first portion of the voice coil is set larger than that of the second portion of the voice coil.

2. The speaker according to claim 1, wherein the first portion of the voice coil has a flange portion protruding inward in the radial direction of the diaphragm, so that the voice coil has a substantially L-shape.

3. The speaker according to claim 1, wherein the first portion of the voice coil has a flange portion protruding outward in the radial direction of the diaphragm, so that the voice coil has a substantially L-shape.

4. The speaker according to claim 1, wherein the first portion of the voice coil has a tapered side surface.

5. A speaker comprising:

a frame having a bottom surface;

a magnet disposed on the bottom surface of the frame;

a yoke disposed on the magnet, a gap being defined between the side surface of the yoke and the frame;

a diaphragm disposed above the yoke; and a voice coil having a first portion bonded to the diaphragm, and a second portion placed in the gap, wherein a thickness of the first portion of the voice coil is set larger than that of the second portion of the voice coil.

6. The speaker according to claim 5, wherein the frame has a substantially circular shape and the bottom surface is positioned at the center of the circular shape.

7. The speaker according to claim 5, wherein the first portion of the voice coil has a flange portion protruding inward in the radial direction of the diaphragm, so that the voice coil has a substantially L-shape.

8. The speaker according to claim 5, wherein the first end portion of the voice coil has a flange portion protruding outward in the radial direction of the diaphragm.

9. The speaker according to claim 5, wherein the first portion of the voice coil has a tapered side surface.

* * * * *